US005083448A

United States Patent [19]

Kärkkäinen et al.

[11] Patent Number: 5,083,448

[45] Date of Patent: Jan. 28, 1992

[54] ELECTROMECHANICAL DOOR LOCK

[75] Inventors: Vesa Kärkkäinen; Keijo Lehikoinen, both of Joensuu, Finland

[73] Assignee: Oy Abloy Security Ltd., Helsinki, Finland

[21] Appl. No.: 435,547

[22] Filed: Nov. 13, 1989

[30] Foreign Application Priority Data

Nov. 25, 1988 [FI] Finland ..... 885477

[51] Int. Cl.[5] ..... E05B 47/00

[52] U.S. Cl. ..... 70/277; 70/107; 70/110; 70/279; 292/144

[58] Field of Search ..... 70/277, 279, 280, 282, 70/107, 110, 129, 134, 141, 144, 155; 292/140, 144, 169.13, 169.14

[56] References Cited

U.S. PATENT DOCUMENTS

| | | | |
|---|---|---|---|
| 1,221,115 | 4/1917 | Voight | 70/110 X |
| 3,242,706 | 3/1966 | Check | 70/110 |
| 3,672,714 | 6/1972 | Schultz | 70/107 X |
| 3,769,822 | 11/1973 | Yulkowski | 70/107 |
| 3,917,329 | 11/1975 | Fujiki et al. | 70/141 X |
| 4,237,711 | 12/1980 | Kambic | 70/150 |
| 4,429,556 | 2/1984 | Kambic | 70/149 |
| 4,583,382 | 4/1986 | Hull | 70/107 |
| 4,665,727 | 5/1987 | Uyeda | 70/279 |
| 4,840,050 | 6/1989 | Gotanda | 70/279 X |
| 4,902,053 | 2/1990 | Hakkainen et al. | 292/144 |

FOREIGN PATENT DOCUMENTS

| | | | |
|---|---|---|---|
| 298292 | 1/1989 | European Pat. Off. | 70/107 |
| 0280755 | 7/1990 | European Pat. Off. . | |

*Primary Examiner*—Gary L. Smith
*Assistant Examiner*—Suzanne L. Dino
*Attorney, Agent, or Firm*—Dellett, Smith-Hill and Bedell

[57] ABSTRACT

An electromechanical door lock comprises a lock body (1), in which is a dead bolt (3) which can be dead locked in its protruding position and electrically withdrawn into the lock body, a latch (4) which is spring loaded to be protruding from the lock body and which centralizes the dead bolt in an opening in a striking plate (18) arranged for the door lock, and force transmission means (8–14) for transmitting force from an electrical operating device (7) to the dead bolt (3). Said latch (4) includes in a way known as such a body member (4c) moveable inside the lock body to which is jointed a wedge-shaped member (4a, 4b), protruding at least partly out from the lock body when the latch is in the protruding position, so that the latch (4) can be pressed inside the lock body when a force acts on said wedge-shaped member (4a, 4b) from either side of the lock body in the direction of the door opening or closing. In addition the lock body includes separate dead locking means (15–17) for the latch, arranged to prevent the latch to be moved inside the lock body. Said force transmission means (8–14) include a force transmission unit (11) moveable at least substantially in the longitudinal direction of the lock body, the transmission movement of which is arranged to release the dead locking of both the dead bolt (3) and the latch (4).

26 Claims, 3 Drawing Sheets 1
2
37
9
16
15
11
4c
17
12
8
4b
4
4a
10
6
35
26
31
25
23
7
24
21
24
3
19
13
28
22
20
11
34
30
14
29
5
33
27
18
2
32
36

ELECTROMECHANICAL DOOR LOCK

The invention relates to an electromechanical door lock.

A problem with electromechanical motor operated door locks, which are also easily arrangeable for remote control, is to ensure the guiding and centralizing of the locking bolt into the opening in the striker plate located opposite to the bolt in the door jamb. For this purpose a lock body is additionally fitted with a latch urged by a spring to extend out from the lock body. The problem is then that the frictional forces from the lateral loading on the bolt and latch make it difficult to move these members back from their extended position in the opening of the lock's striker plate into the lock body. Another aim, on the other hand, is to provide a lock body of such dimensions so as to fulfill norms set for the size of lock bodies, for example the German DIN norms in question. In that case in practice it is difficult to fit a sufficiently powerful electric motor into the lock body, which has the ability to simultaneously withdraw both the bolt and the latch inside the lock body. The lock body's suitability for remote control is weak in case the latch is to be operated always with separate manual operating means.

One solution to the problem mentioned above is presented in Finnish patent application No. 880953 (corresponding to the EP application no. 87103206), according to which the lock's bolt and latch are withdrawn into the lock body by means of an electric motor but at slightly different times, whereby the withdrawal phase of the bolt and of the latch respectively uses a different gear ratio in the mechanism between the electric motor and said lock parts. As a result this known arrangement has complicated construction and, in addition, according to this solution the bolt has two different withdrawn positions within the lock body.

The object of the invention is to eliminate the difficulties revealed by the known art and to resolve said problems in a new way. The object of the invention is at the same time to achieve a lock body fitted with an electrically withdrawable bolt and which is well suited for remote control operation, has an uncomplicated construction, is reliable to operate and is also of compact dimensions so as to meet space requirements.

In the invention a known pivoted latch construction is employed in a new and advantageous way to solve the said problems, the exact construction and operating particulars of which are presented in British patent application GB 2203794 A, which is hereby incorporated by reference. By applying said latch construction in a way taught by the invention in an electrically operated door lock the invention refers to, a lock body is accomplished, in which the lock's bolt is properly centralized by the latch, but in which the withdrawal of the latch does not require any separate operating means in the lock body. Specifically, if the bolt is first drawn into the lock body and the door is opened or shut with a push so that the latch presses against the striking plate, the striking plate at the same time presses the latch inwards into the lock body in the same way as a conventional latch bolt is forced to move into the lock body. The difference is however, that a conventional latch bolt can be pressed inside the lock body in this way only when the door is shutting, whereas the bolt construction to be applied in the invention is additionally pressable in this way into the lock body when the door is opening.

A condition of the operation of the latch described above is naturally, that the dead locking of the latch must first be freed. This can most advantageously be achieved by employing a force transmission unit moving mainly in the lengthwise direction of the lock body and which at the same time is arranged to take off also the dead locking of the bolt. In this way an uncomplicated construction is achieved for the lock body.

Said force transmission unit can in one extreme position itself act advantageously as the means for dead locking the bolt. In that case the movement of the force transmission unit from the dead locked position of the bolt to a second extreme position can be arranged simultaneously to achieve effectively the withdrawal of the bolt into the lock body.

The unlocking of the latch from its dead locked mode is most effectively arranged at the final stage of the withdrawal of the bolt into the lock body, preferably when the bolt is completely removed from the opening in the striking plate. In this way the frictional forces acting on the sides of the bolt are advantageously eliminated.

Against possible electrical failure or for emergency operation the lock body is preferably fitted with operating axes for provision of key operation and for handle or turning knob use, so that also these means are arranged to effect said force transmission unit so that it moves the bolt into its unlocked position.

Both from the viewpoint of space requirements and production technique an advantageous solution is achieved when the force transmission unit comprises one functionally uniform, plate shaped member. Depending on the requirements set for the dimensions of the lock body the force transmission unit can in practice be one piece, but it can if necessary also be made of several parts, which are however joined together so that they form one functional entity.

The invention is described in the following annotated drawings in which

Figure 3:
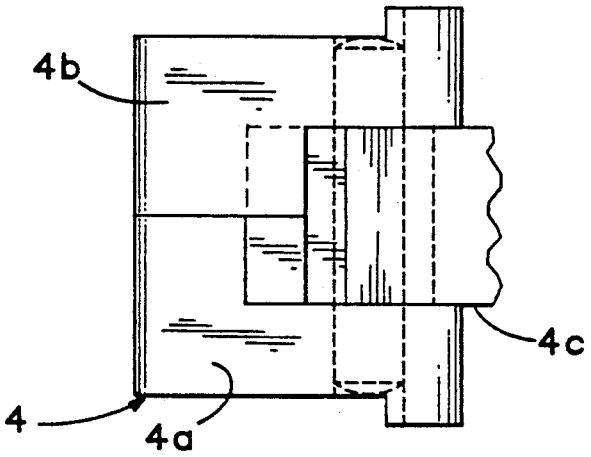
FIG. 3 is an enlarged partial side elevation of the latch of the lock shown in FIGS. 1 and 2.
Figure 4A:
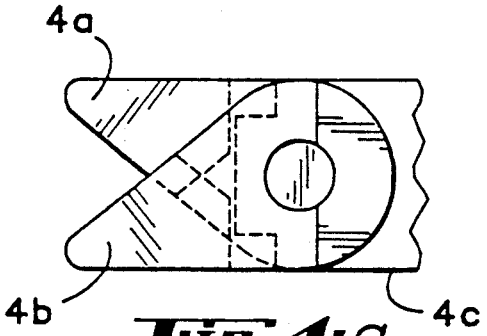
Figure 4B:
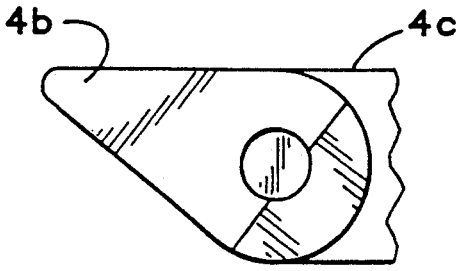

FIGS. 4*a* and 4*b* are top plan views of the latch shown in FIG. 3.

In the drawings the reference numeral 1 indicates a lock body, which is mounted in a door 36 and which has a front plate 2. In the lock body is a dead bolt 3, which is pressed by a spring 5 into its extended, locked position, and a latch bolt 4, which a spring 6 presses out of the lock body. The latch 4 comprises a body part 4*c* which is moveable inside the lock body and to which an end part extending outside the lock body is pivoted so as to be turnable around an axis extending in the longitudinal direction of the lock body. The end part of the latch comprises in the embodiment illustrated two separate wedge shaped outwardly tapering pieces 4*a* and 4*b*, but as well the end part could be formed from only one wedge shaped end member pivoted to the body part 4*c* as is presented in the previously mentioned British patent application GB 2203794 A.

The lock body also includes an electric motor 7, which by means of force transmission means 8, 9 and 10 is arranged to act upon an arm 12 in a force transmission piece 11 moveable in the longitudinal direction of the lock body. The manner of construction and operation of the latch bolt 4 is fully described in U.S. Pat. No. 4,902,053, which corresponds to British patent application GB 220379 4 A. The force transmission piece 11 also includes a control slot 14, which is of cooperation with a control pin 13 of the bolt 3 for withdrawing the bolt. The control slot 14 is so shaped, that in the extreme position in FIG. 1 it will at the same time dead lock the bolt 3 by means of the control pin 13 when in the extended position (see FIG. 1).

The lock body is also fitted with dead locking means 15 for the latch 4 and a spring 16, which presses the dead locking means 15 into the dead locked position against a stop face 17 of the body part 4c of the latch.

The lock body is further fitted with an auxiliary bolt 19, which a spring 20 presses toward the exterior of the lock body. In the mode shown in FIG. 1 the auxiliary bolt 19 is pressed against a striking plate 18, which is positioned in a door jamb 37 or the like frame construction arranged for the door and relative to which the door is turnable. The auxiliary bolt 19 is fitted with a stop face 21, which when the bolt 3 is in the withdrawn position is in cooperation with a stop 22 of the force transmission piece 11 thus preventing the force transmission piece 11 from moving downwards in FIG. 2 and at the same time preventing the bolt from moving outwards into its locked position.

Figure 1:
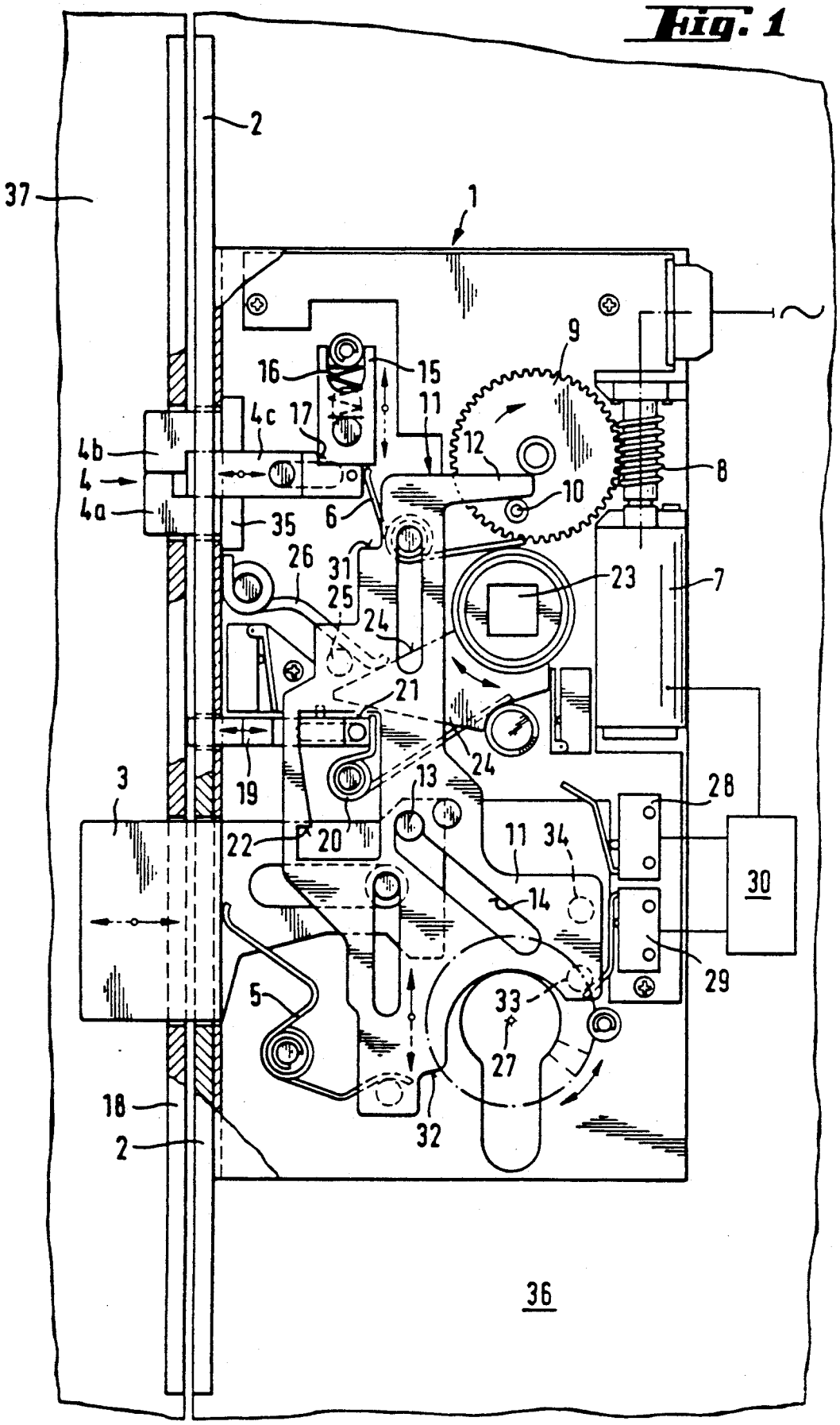
FIG. 1 shows a sideview of a lock body according to the invention, and in which the bolt and latch of the lock are in the locked position with the door closed.

In the situation shown in FIG. 1 the bolt 3 and latch 4 are dead locked in their extended locked positions, when the door is locked. When the electric motor 7 has with the aid of force transmission means 8, 9, 10 moved force transmission piece 11 to the position shown in FIG. 2, the slot 14 in the force transmission piece has at the same time moved the bolt 3 into its withdrawn position by means of the control pin 13. At the same time a guide surface 31 of force transmission piece 11 has moved the dead locking means 15 for the latch 4 into the unlocked position. In that case the door can be opened with a push, as the end part of latch 4 presses against the edge of the opening in the striking plate and, at the same time, it turns a little around its pivot axis, and as a consequence thereof, the latch is pressed against the force of spring 6 into the lock body. It is important to mention that only part 4a turns in this case, as part 4b is already in the position, in which it can be pressed inside the lock body as a latch bolt.

Figure 2:
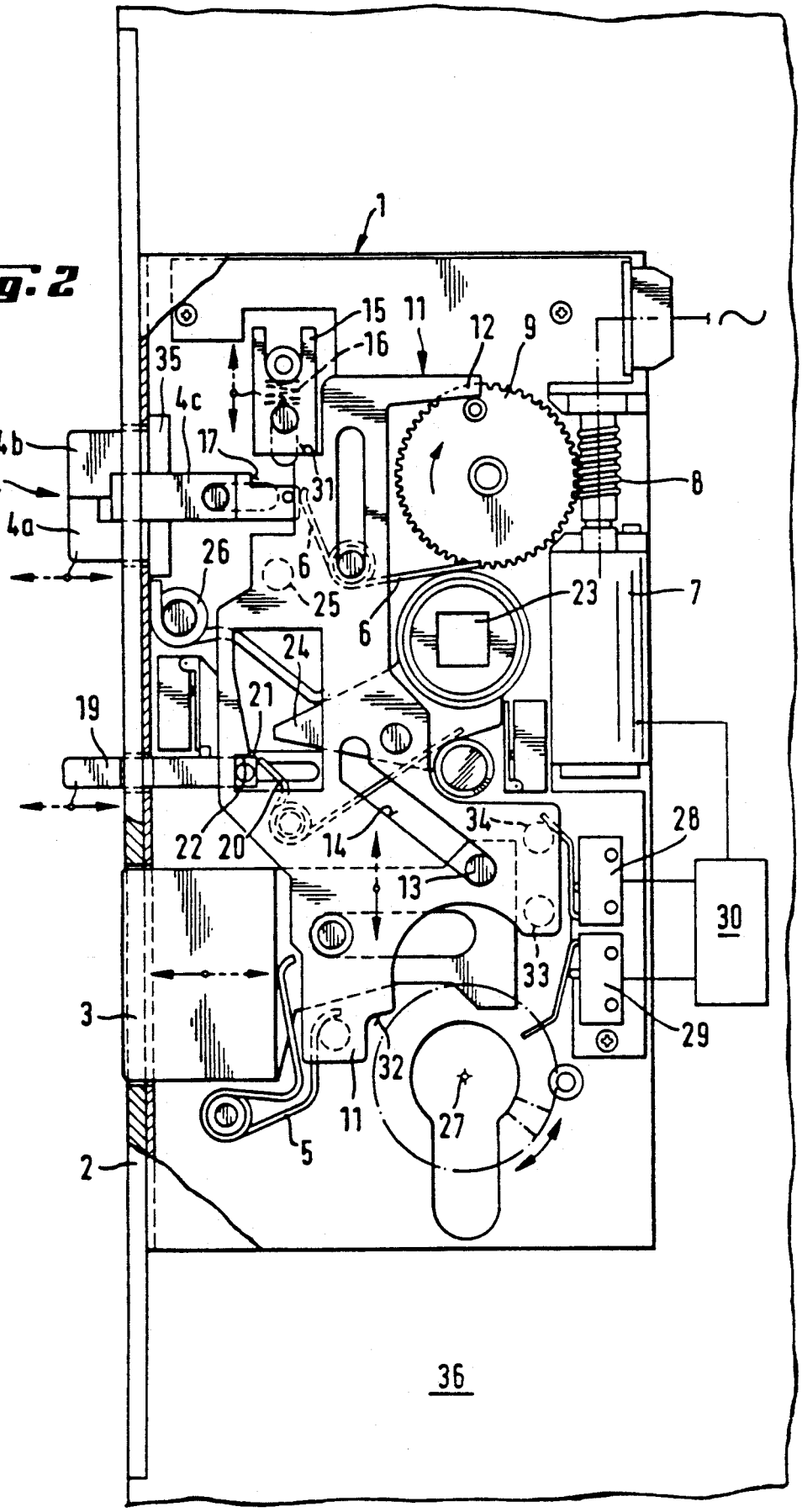
FIG. 2 shows the lock in FIG. 1 with the bolt and latch in their corresponding positions when the door is open.

When the door is pushed past the striking plate 18, the situation shown in FIG. 2 occurs. In that case the spring 6 pushes the latch 4 again into its position extending from the lock body and at the same time the end part 4a turns under the influence of the spring 6 and stop 35 back to its original position. In the same way the auxiliary bolt 19 moves to its extended position under influence of the spring 20 so that the stop 21 of the auxiliary bolt 19 is situated below the arm 22 of the force transmission piece 11 thus preventing the force transmission piece 11 from moving downwards in FIG. 2 and at the same time moving the bolt 3 into its locked position outside the lock body.

The motor 7 can in a way known as such be programmed after a certain delay to move the force transmission means 8, 9, 10 back into their positions shown in FIG. 1. When the door is then pushed shut, the latch 4 and auxiliary bolt 19 strike against the edge of the striking plate 18, which pushes both of them into their withdrawn position. It is important to point out that in this case only the end part 4b turns because the part 4a is already in its yielding position. In that case the stop 21 of auxiliary bolt 19 moves away from under the arm 22 of the force transmission piece 11 thus freeing the force transmission piece 11 to move back into the position shown in FIG. 1. As soon as the latch 4 is positioned opposite the opening in the striking plate the spring 6 presses the latch 4 out of the lock body and the bolt 3 moves under pressure of the spring 5 to its extended position into its own opening in the striking plate 18. In its extended position the latch 4 at the same time centers the door in position relative to the striking plate 18. As is shown in FIG. 1 the auxiliary bolt 19 is pressed against the striking plate 18, because there is no opening provided in the striking plate for the auxiliary bolt 19.

As a precaution against electricity failure, malfunction of the electric motor or for emergency operation the lock body is fitted with operating axes 23 and 27. In operating axis 23 there is a follower 24 arranged to be turnable against the force of a spring 26 by means of a handle, turning knob or similar on the inside of the door. With the aid of a control pin 25 of force transmission piece 11 the follower 24 can independently move the force transmission piece 11 upwards in the figures to the opening mode of the bolt 3. In that case the door can always be opened by pressure from the inside. Particularly in cases when a handle is used as the operating means, the spring 26 will ensure that the handle will remain level.

Correspondingly operating axis 27 is fittable with key operable means, for example a cylinder lock, the force transmission member of which being arranged to act on the force transmission piece 11 through a stop 32 thereof so as to push the bolt 3 in a corresponding way into its free position in the lock body.

The lock body is also fitted with micro switches 28 and 29, which are arranged to operate in cooperation with the control pins 33 an 34 of force transmission piece 11. Because the movements of force transmission piece 11 also affect the position of the bolt 3, in this way the state of the bolt and the lock can be detected unambiguously. This information can be fed to a control unit 30, which can be arranged to control the operation of the motor 7. The matter is represented only schematically in the figures. In this way the lock can be easily arranged for remote control in a way known as such.

Control unit 30 can be situated either in the lock body itself or, by means of leads, outside the lock body as required. As is again illustrated in FIG. 1 the lock body is also equipped for external power supply.

The invention is not limited to the embodiments described, since several modifications thereof are feasible within the scope of the following claims.

We claim:

1. An improved electromechanical door lock comprising a lock casing, a dead bolt that is linearly movable relative to the lock casing between a protruding position, in which the dead bolt protrudes from the lock casing and can be dead locked, and a withdrawn position within the lock casing, a latch that is linearly movable relative to the lock casing between a protruding position and a withdrawn position and is spring loaded toward its protruding position, in which the latch centralizes the dead bolt relative to an opening in a striker plate for the door lock, an electrical operating device, and force transmission means for transmitting force from the electrical operating device to the dead bolt so as to move the dead bolt from its protruding position to its withdrawn position, wherein the improvement resides in that:

the latch comprises a movable body member inside the lock casing and a wedge-shaped member protruding at least partly out from the lock casing when the latch is in its protruding position, the wedge-shaped member being connected to the body member in a manner permitting pivotal movement of the wedge-shaped member relative to the body member so that the latch is urged toward its withdrawn position when a force acts on said wedge-shaped member from either side of the lock casing in the direction of door opening or closing, the lock includes dead locking means for the latch, for preventing movement of the latch from its protruding position towards its withdrawn position, and the force transmission means include a force transmission unit movable at least substantially in a longitudinal direction of the lock casing, movement of the force transmission unit causing release of the dead locking of both the dead bolt and the latch.

2. A door lock according to claim 1, wherein the force transmission unit is movable between a first extreme position, in which both the dead bolt and the latch are dead locked, and a second extreme position, in which the dead bolt is in its withdrawn position and the latch is not dead locked, and movement of the force transmission unit from the first extreme position to the second extreme position releases the dead locking of the latch only after the dead bolt has been released from dead locking.

3. A door lock according to claim 2, wherein such movement of the force transmission unit releases the dead locking of the latch only after the dead bolt has been moved substantially completely from its protruding position toward its withdrawn position.

4. A door lock according to claim 1, wherein said force transmission unit is movable within a range between a first extreme position and a second extreme position, and the force transmission unit cooperates with the dead bolt to achieve dead locking of the dead bolt in the first extreme position of the force transmission unit.

5. A door lock according to claim 4, wherein the force transmission unit cooperates with the dead bolt so that movement of the force transmission unit from the first extreme position to the second extreme position brings about withdrawal of the dead bolt into the lock casing.

6. A door lock according to claim 4, comprising a rotational operating member that can be rotated by application of manual force from outside the lock casing to bring about movement of the force transmission unit from its first extreme position.

7. A door lock according to claim 6, wherein the rotational operating member is adapted to be rotated by means of a key.

8. A door lock according to claim 4, comprising a rotational operating member and a follower responsive to the rotational operating member for moving the force transmission unit from its first extreme position.

9. A door lock according to claim 8, wherein the rotational operating member is adapted to be rotated by means of a turning knob, a handle or like member.

10. A door lock according to claim 1, comprising a resilient member urging the dead bolt toward its protruding position, and an auxiliary bolt for preventing movement of the dead bolt from its withdrawn position.

11. A door lock according to claim 1, wherein said force transmission unit comprises a plate-like member including force transmission and control formations for said dead locking operations, and formations for separately bringing about movement of the force transmission unit in response to the electrical operating device or a manually actuated operating member.

12. A door lock according to claim 1, comprising a resilient member urging the dead bolt toward its protruding position, and an auxiliary bolt that is movable between a withdrawn position, in which it does not engage the force transmission unit, and a protruding position, in which it interferes with movement of the force transmission unit.

13. A door lock according to claim 1, wherein the force transmission unit is movable within a range between a first extreme position, in which the dead bolt is in its protruding position and is dead locked and the force transmission unit allows the dead locking means for the latch to engage the latch, and a second extreme position, in which the dead bolt is in its withdrawn position and the force transmission unit holds the dead locking means for the latch out of engagement with the latch, and movement of the latch from its withdrawn position to its protruding position is independent of the force transmission unit.

14. An electromechanical door lock comprising:

a lock casing, a dead bolt linearly movable relative to the lock casing between a protruding position, in which the dead bolt protrudes from the lock casing and can be dead locked, and a withdrawn position within the lock casing, latch means comprising a latch which is spaced apart from the dead bolt in a longitudinal direction of the lock casing and is linearly movable relative to the lock casing between a protruding position and a withdrawn position, and spring means urging the latch toward its protruding position, said latch comprising a movable body member inside the lock casing and a wedge-shaped member protruding at least partly out from the lock casing when the latch is in its protruding position and connected to the body member in a manner permitting pivotal movement of the wedge-shaped member relative to the body member about an axis parallel to said longitudinal direction so that the latch is urged toward its withdrawn position when a force acts on said wedge-shaped member in a direction perpendicular to both said axis and the direction of movement of the latch, dead locking means for the latch, for preventing movement of the latch from its protruding position towards its withdrawn position, an electrical operating device, and force transmission means for transmitting force from the electrical operating device to the dead bolt so as to move the dead bolt from its protruding position to its withdrawn position, said force transmission means including a single rigid force transmission member movable at least substantially in the longitudinal direction of the lock casing, movement of said force transmission member causing release of the dead locking of both the dead bolt and the latch.

15. A door lock according to claim 14, wherein the force transmission member is movable with a range between a first extreme position, in which the dead bolt is in its protruding position and is dead locked and the force transmission member allows the dead locking means for the latch to engage the latch, and a second extreme position, in which the dead bolt is in its withdrawn position and the force transmission member holds the dead locking means for the latch out of engagement with the latch, and movement of the latch from its withdrawn position to its protruding position is independent of the force transmission member.

16. Access control apparatus comprising a door jamb, a striker plate fitted to the door jamb and formed with a dead bolt opening and a latch opening, a door movable relative to the door jamb between an open position and a closed position, and a door lock mounted in the door to cooperate with the striker plate for selectively retaining the door in its closed position, the lock comprising:

a lock casing mounted in the door, a dead bolt linearly movable relative to the lock casing between a protruding position, in which the dead bolt protrudes from the lock casing and can be dead locked, and a withdrawn position within the lock casing, latch means comprising a latch which is spaced apart from the dead bolt in a longitudinal direction of the lock casing and is linearly movable relative to the lock casing between a protruding position in which the latch enters the latch opening in the striker plate and centralizes the dead bolt relative to the dead bolt opening in the striker plate, and a withdrawn position, and spring means urging the latch towards its protruding position, said latch comprising a movable body member inside the lock casing and a wedge-shaped member protruding at least partly out from the lock casing when the latch is in its protruding position, the wedge-shaped member being connected to the body member in a manner permitting pivotal movement of the wedge-shaped member relative to the body member so that the latch is urged toward its withdrawn position when a force acts on said wedge-shaped member from either side of the lock casing in the direction of door opening or closing, dead locking means for the latch, for preventing movement of the latch from its protruding position towards its withdrawn position, an electrical operating device, and force transmission means for transmitting force from the electrical operating device to the dead bolt so as to move the dead bolt from its protruding position to its withdrawn position, said force transmission means including a rigid force transmission member movable at least substantially in the longitudinal direction of the lock casing, movement of said force transmission member causing release of the dead locking of both the dead lock and the latch.

17. Apparatus according to claim 16, wherein the force transmission member is movable between a first extreme position, in which both the dead bolt and the latch are dead locked, and a second extreme position, in which the dead bolt is in its withdrawn position and the latch is not dead locked, and movement of the force transmission member from the first extreme position to the second extreme position releases the dead locking of the latch only after the dead bolt has been released from dead locking.

18. Apparatus according to claim 17, wherein such movement of the force transmission member releases the dead locking of the latch only after the dead bolt has been moved substantially completely from its protruding position toward its withdrawn position.

19. Apparatus according to claim 16, wherein said force transmission member is movable within a range between a first extreme position and a second extreme position, and the force transmission member cooperates with the dead bolt to achieve dead locking of the dead bolt in the first extreme position of the force transmission member.

20. Apparatus according to claim 19, wherein the force transmission member cooperates with the dead bolt so that movement of the force transmission member from the first extreme position to the second extreme position brings about withdrawal of the dead bolt into the lock casing.

21. Apparatus according to claim 19, comprising a rotational operating member that can be rotated by application of manual force from outside the lock casing to bring about movement of the force transmission member from its first extreme position.

22. Apparatus lock according to claim 19, comprising a rotational operating member and a follower responsible to the rotational operating member for moving the force transmission member from its first extreme position.

23. Apparatus according to claim 16, comprising a resilient member urging the dead bolt toward its protruding position, and an auxiliary bolt for preventing movement of the dead bolt from its withdrawn position.

24. Apparatus according to claim 16, wherein said force transmission member comprising a plate-like member including force transmission and control formations for said dead locking operations, and formations for separately bringing about opening movement of the force transmission member in response to the electrical operating device or a manually actuated operating member.

25. Apparatus according to claim 16, comprising a resilient member urging the dead bolt toward its protruding position, and an auxiliary bolt that is movable between a withdrawn position, at which it does not engage the force transmission member, and a protruding position in which is interferes with movement of the force transmission member.

26. Apparatus according to claim 16, wherein the force transmission member is movable within a range between a first extreme position, in which the dead bolt is in its protruding position and is dead locked and the force transmission member allows the dead locking means for the latch to engage the latch, and a second extreme position, in which the dead bolt is in its withdrawn position and the force transmission member holds the dead locking means for the latch out of engagement with the latch, and movement of the latch from its withdrawn position to its protruding position is independent of the force transmission member.

* * * * *